US005595125A

United States Patent [19]

Bridges, Jr.

[11] Patent Number: 5,595,125

[45] Date of Patent: Jan. 21, 1997

[54] CORRUGATED PAPER PALLET

[76] Inventor: Robert L. Bridges, Jr., 158 Kenan Dr. NW., Milledgeville, Ga. 31061

[21] Appl. No.: 398,675

[22] Filed: Mar. 6, 1995

[51] Int. Cl.[6] ..... B65D 19/00

[52] U.S. Cl. ..... 108/51.3

[58] Field of Search ..... 108/51.3, 51.1

[56] References Cited

U.S. PATENT DOCUMENTS 2,444,183 6/1948 Cahners ..... 108/51.3

3,464,371 9/1969 Gifford ..... 108/51.3

*Primary Examiner*—Peter M. Cuomo
*Assistant Examiner*—Gerald A. Anderson
*Attorney, Agent, or Firm*—Earl D. Harris

[57] ABSTRACT

A lightweight, disposable, corrugated paper pallet formed by a plurality of corrugated paper runners, traversing the length the pallet, each runner enveloped by a continuous corrugated paper inner sheet, which itself is bonded to the lower side of a reinforced corrugated paper top deck and to the upper side of a corrugated paper bottom stabilizing deck.

4 Claims, 2 Drawing Sheets

FIG. 1
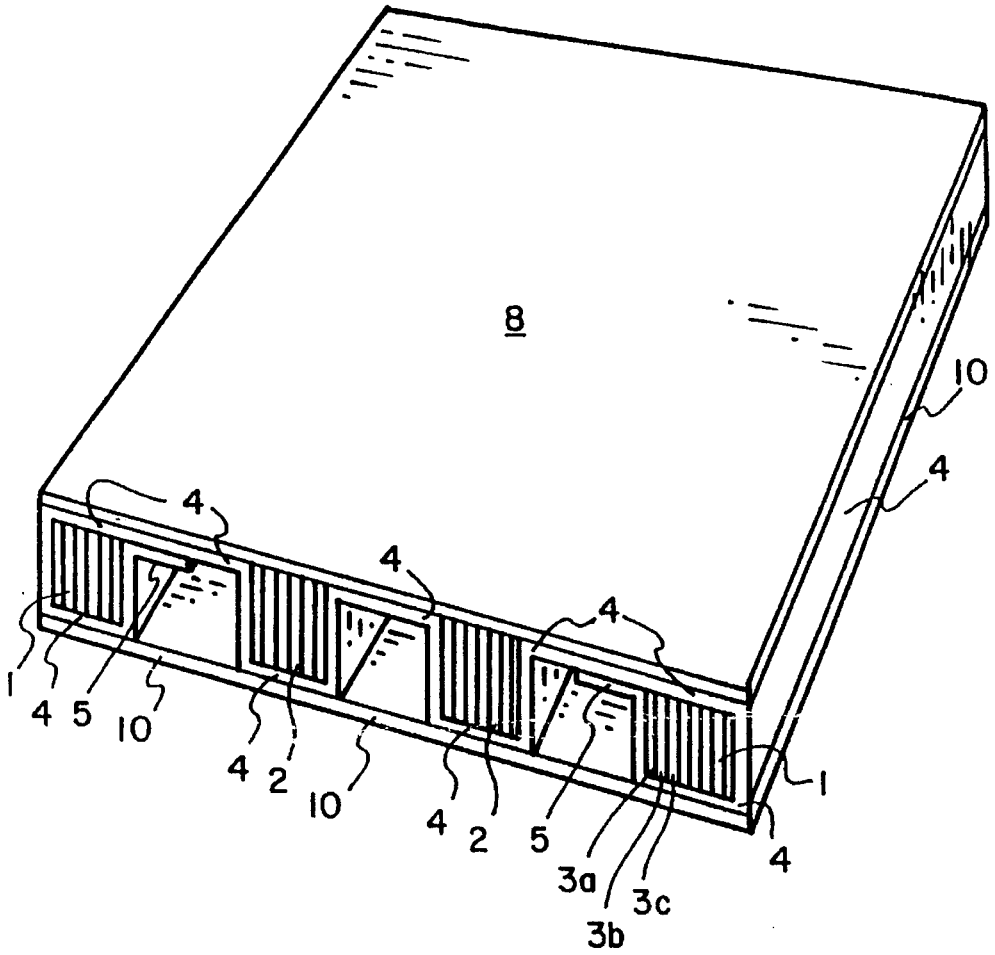
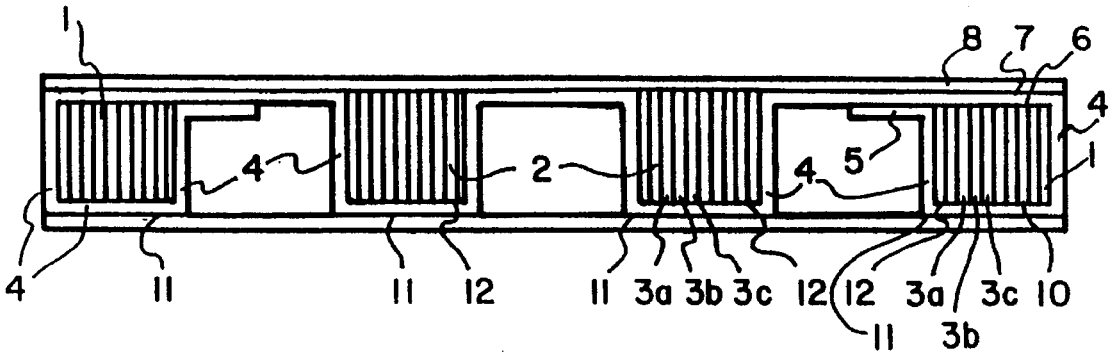
FIG. 2

FIG. 3
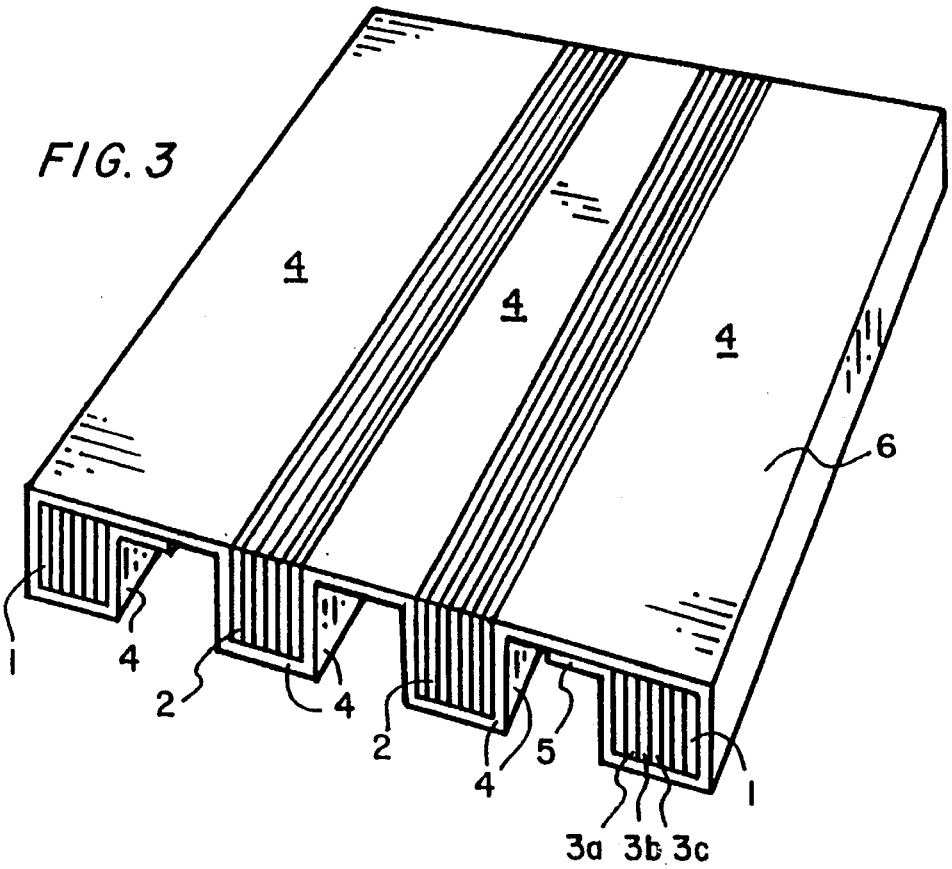
FIG. 4
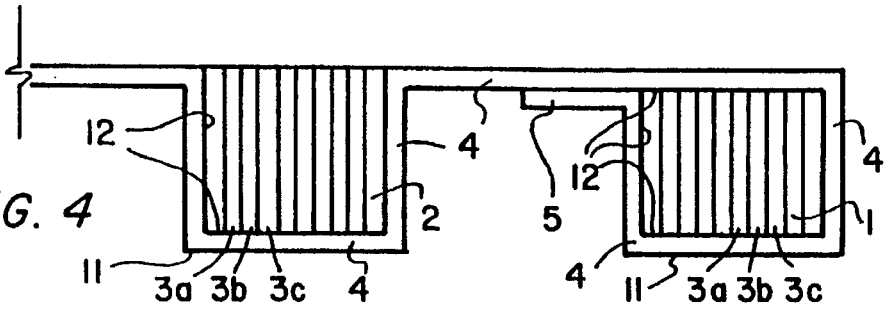
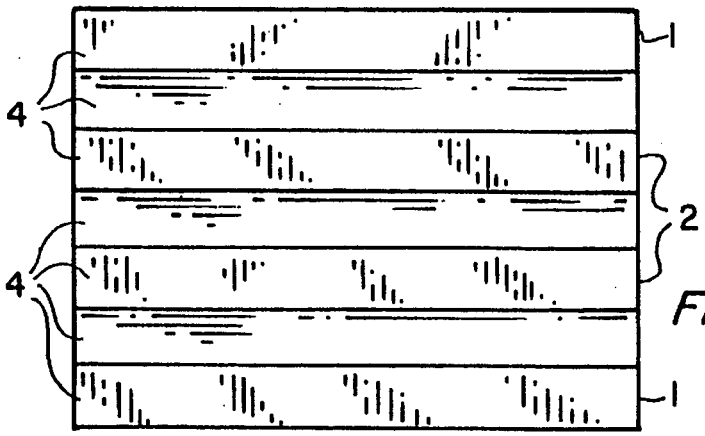
FIG. 5

CORRUGATED PAPER PALLET

BACKGROUND OF THE INVENTION

The present invention relates generally to an improvement in lightweight, disposable pallets fabricated of corrugated paper or similar flat sheet material that is relatively ridged but capable of being formed in right angle bends without breaking.

Pallets are extensively used in today's industries for storing and transportation of heavy and bulk materials and goods that are generally packaged in separate cartons, bags, boxes and other similar containers. Many of such pallets now in use utilize wood in both the decking and runners for strength. However, unless the pallets are used exclusively "in-house" and with reasonable care, the lack of uniformity in manufacture and damage incurred in handling makes it virtually impossible to reuse or recycle existing pallets. Further, the wood or metal utilized in manufacture adds substantially to transport weight, and collection and retransport of the pallets is cost prohibitive.

Attempted reuse is labor-intensive in sorting, repairing, and moving the pallets utilizing wooden parts, and costly in storage and transportation back to the initial user. Therefore, a common practice has been to dispose of such pallets after initial use, a practice that is itself costly and an under-utilization of resources.

Fastening devices, such as nails, screws and staples, that are commonly used to assemble pallets are subject to damaging and weakening the material employed in the pallet (i.e., split the wood) structurally weakening the pallet itself, or protruding from the surface, catching onto and often damaging the goods being stored or transported. Habitually these protruding fasteners become an actual physical danger to the handlers of the pallets, causing puncture and laceration wounds, in addition to potentially damaging other goods in the vicinity.

SUMMARY OF THE INVENTION

The present invention overcomes the problems associated with the inadequacies of such prior pallets by providing a lightweight but strong pallet made exclusively of corrugated paper bonded together with glue and crimping methods.

A primary object of the present invention is to provide a simple and dependable pallet that is economical in construction and strong enough to transport and store heavy loads.

A further object of the invention is to provide a commercial pallet that is lightweight and easily stored and transported itself.

A further object of the present invention is to provide a commercial pallet that is completely disposable and recyclable.

A further object of the invention is to provide a commercial pallet that is safe both for the user and for goods being transported or stored.

These and other more particular advantages and objects of the invention will become clear and better understood through the following description and claims.

BRIEF DESCRIPTION OF THE DRAWINGS

FIG. 1 is a perspective view of the corrugated paper pallet showing the top, one side and one end of the pallet, exposing the top deck, inner sheet, runners and bottom sheet for view.

FIG. 2 is a frontal elevation view of the pallet, again showing the top deck, inner sheet, runners and bottom sheet.

FIG. 3 is fragmentary prospective view of the runners and the inner sheet without either the top or bottom sheets attached.

FIG. 4 is a detail end view of one of the center runners and a side runner with the inner sheet properly attached.

FIG. 5 is fragmentary bottom elevation view without the bottom sheet attached.

DETAILED DESCRIPTION OF THE PREFERRED EMBODIMENT

Although as can be seen in the drawings and in this description numerous embodiments of the present invention are possible, the preferred embodiment, as shown in FIGS. 1–5, begins with a plurality of side runners 1 and center runners 2, each consisting of a plurality of corrugated paper runner elements 3. The runner elements 3 are themselves corrugated paper of a uniform width and length bonded together with high-strength glue and crimped by a commonly-known piercing method that penetrates each layer of the plurality of runner elements 3 (e.g.: forcing a part of one runner element 3*a* through the hole created in the adjoining runner elements 3*b*, 3*c*, . . . , etc.).

FIGS. 3 and 4 show the wrapping of an inner sheet 4 of corrugated paper completely around the side runners 1 and around two sides and the bottom of the center runners 2. The inner sheet 4 and the respective runners 1, 2 are bonded with high-strength glue at all contact points 12. These Figures also show a one-inch minimum overlap 5 of the inner sheet 4 at the inside upper corner of each of the side runners 1. The overlap 5 is also bonded with high-strength glue to the underside 6 of the inner sheet 4.

A sesame tape reinforced double-walled corrugated paper top deck 8 is likewise bonded on its lower-side 9 with high-strength glue to the upperside 7 of the inner sheet 4. The pallet is completed by gluing a bottom deck 10 of corrugated paper to the inner sheet 4 at all contact points 11.

Obviously, many modifications and variations of the invention are possible in light of the above teachings. It is therefore understood that the invention is not to be limited by the single embodiment shown in the drawings and described in the description, which are given by way of example and not of limitation, but only in accordance with the scope of the appended claims.

What is claimed is:

1. A corrugated paper pallet for supporting containers and bulk material comprising:

a left and a right side runner and a first and a second center runner, each having a top, a bottom, a left side and a right side, and each fabricated of a plurality of corrugated paper runner elements aligned vertically, and laminated and fixably attached together;

a corrugated paper inner sheet having an upper and lower surface, said sheet wrapping completely around and being fixably attached to the right side, bottom, left side and top of the left side runner, extending from the top of said left side runner a distance of the width of a fork-lift tine to the left side of the first center runner, wrapping around and being fixably attached to the left side, bottom and right side of said center runner, extending therefrom the distance of the width of a forklift line to the left side of the second center runner and wrapping around and being fixably attached to the left side, bottom and right side of said second center runner, and finally extending therefrom the distance of the width of a fork-lift tine to the top of, wrapping completely around and being fixably attached to the top, right side, bottom and left side of the right side runner, where overlaps of said inner sheet are available on the right side of the left side runner and on the left side of the right side runner and said overlaps are themselves fixably attached to the lower side of said inner sheet near the top of the side runners;

a double-walled, sesame-tape-reinforced corrugated paper top deck fixably attached to the upper side said inner sheet and the top of said center runners;

a corrugated paper bottom deck fixably attached to the inner sheet at the points adjacent to the bottom of the said side and center runners;

a means of fixably attaching said runner elements together, of fixably attaching said inner sheet to said runners, of fixably attaching said overlaps to the lower side of said inner sheet, of fixably attaching said top deck to said inner sheet and center runners, and of fixably attaching said bottom deck to said inner sheet, said means being capable of bonding said respective parts into one laminated unit.

2. A corrugated paper pallet of claim 1 wherein the means of fixably attaching is high-strength glue.

3. A corrugated paper pallet of claim 1 wherein the means of fixably attaching is by crimping using a commonly-known piercing method that penetrates each layer of the plurality of runner elements forcing a part of one runner element through the adjoining runner elements.

4. A corrugated paper pallet of claim 1 wherein the means of fixably attaching are wire staples.

* * * * *